United States Patent [19]

Griggs

[11] Patent Number: 4,552,160

[45] Date of Patent: Nov. 12, 1985

[54] ATTACHING AN ARTIFICIAL NAIL

[75] Inventor: Gloria D. Griggs, Dallas, Tex.

[73] Assignee: Tip-N-Wrap, Inc., Dallas, Tex.

[21] Appl. No.: 677,319

[22] Filed: Dec. 3, 1984

Related U.S. Application Data

[63] Continuation of Ser. No. 454,436, Dec. 29, 1982, abandoned.

[51] Int. Cl.[4] ..... A45D 29/00

[52] U.S. Cl. ..... 132/73; 132/88.5

[58] Field of Search ..... 132/73, 73.5, 88.5, 132/88.7

[56] References Cited

U.S. PATENT DOCUMENTS

| | | | |
|---|---|---|---|
| 2,166,950 | 7/1939 | German et al. | 273/82 A |
| 3,478,756 | 11/1969 | Sautter et al. | 132/73 |
| 3,552,401 | 1/1971 | Michaelson | 132/73 |
| 4,007,748 | 2/1977 | Matranga et al. | 132/73 |
| 4,157,095 | 6/1979 | Sweet | 132/73 |
| 4,299,243 | 11/1981 | Umstattd | 132/73 |
| 4,407,310 | 10/1983 | Jadow | 132/73 |

*Primary Examiner*—Gene Mancene
*Assistant Examiner*—Carolyn A. Harrison
*Attorney, Agent, or Firm*—McCord & McCord

[57] ABSTRACT

A method for attaching an artificial fingernail or toenail to the tip of a natural fingernail or toenail, comprising a plurality of steps whereby the artificial nail is secured to the tip of the natural nail with an adhesive material comprised of ethyl alpha cyanoacrylate and a rayon fiber material is secured to the exposed surfaces of the attached natural and artificial nails. The method further includes a plurality of shaping and smoothing steps, whereby the artificial nail is trimmed to the desired shape and length and the exposed surfaces of the natural and artificial nails are filed and buffed until smooth. The result of the method of the present invention is a strong, natural-looking nail which is porous enough to allow the nail to "breathe" and is resistant to breaking and cracking.

9 Claims, 9 Drawing Figures

ATTACHING AN ARTIFICIAL NAIL

This application is a continuation of application Ser. No. 454,436, filed Dec. 29, 1982, now abandoned.

BACKGROUND OF THE INVENTION

1. Field of the Invention

The present invention relates to care and maintenance of fingernails and toenails, and more specifically to a method for attaching artificial nails to natural fingernails and toenails.

2. Description of the Prior Art

It is considered fashionable and enhancing to the feminine appearance to have long, well cared for fingernails. Long fingernails project beyond the tip of the finger or nail bed, often up to a distance of one-half (½) inch or more, and as such, are especially susceptible to breaking, cracking or splitting. Various methods have been used to attach an artificial nail to a natural nail. These methods generally fall into two major categories.

The first is the so-called "sculptured nail" method whereby a mask having a cut-out conforming to the length and shape of the desired nail is placed around the natural nail and a paste-like coating of material is applied, which hardens and forms an artificial nail conforming to the shape of the cut-out. This method has several disadvantages. The resultant nails are non-porous, making it difficult for the nail to "breathe", and contributing to skin irritation and fungus growth beneath the nail. Furthermore, the sculptured nails are brittle and easily susceptible to cracking and splitting and are difficult to remove. Typically, the sculptured nail must be fractured and chipped away from the natural nail, which is a laborious process and may result in trauma to the underlying natural nail and finger. In addition, it is often difficult to match the size and shape of the mask cut-out with that of the natural nail.

The second method involves attaching a preformed artificial nail to the upper surface of the natural nail with an adhesive substance and trimming and polishing the artificial nail and the natural nail to achieve the desired length and shape and a smooth finish. Typically, a "wrap" material, which, for example, may be comprised of a thin layer of paper, linen or silk, is attached to the nail using an adhesive material after the artificial and natural nails are joined together. The wrap material is then filed into the surface of the nail to provide a more natural-looking, translucent nail and to strengthen the attachment of the natural and artificial nails. This method also has several disadvantages. First, the adhesive material, which is typically comprised of a fast-drying glue, often produces a burning sensation in the skin during and immediately after the attachment of the artificial and natural nails and results in irritation of the skin. In addition, the wrap material is typically folded underneath the nail, thereby contributing to the formation of fungus growths beneath the nail. Another disadvantage of this method is that the wrap material is readily dissolved by nail polish remover which is applied to the nail surface and which penetrates the surface of the nail, thereby weakening the connection between the artificial and natural nail.

OBJECTS OF THE INVENTION

It is, therefore, the principal object of the present invention to provide an improved method of attaching an artificial nail to a natural nail.

It is yet another object of the invention to provide a stronger, longer lasting artificial fingernail.

It is still another object of the invention to provide a more natural-looking artificial fingernail.

It is still another object of the invention to provide an artificial nail which is resistant to cracking, breaking and splitting.

It is a further object of the invention to provide a method for attaching an artificial nail to a natural nail, which allows the natural nail to breathe, thereby inhibiting the growth of fungus beneath the nail.

It is still a further object of the invention to provide a safe, painless method of attaching an artificial fingernail to a natural fingernail.

SUMMARY OF THE INVENTION

These and other objects are accomplished in accordance with the present invention whereby a method of attaching an artificial nail to a natural nail is comprised of the steps of (1) attaching the artificial nail to the natural nail using a liquid adhesive material; (2) buffing the surfaces of the artificial nail and the natural nail until the surface of the artificial nail is substantially flush with that of the natural nail; (3) placing a precut layer of non-woven, randomly intermingled cellulose fibers over substantially the entire surfaces of the natural and artificial nails without contacting the cuticle of the natural nail, the fibers being oriented substantially along the major axes of the respective surfaces of the natural and artificial nails; (4) applying the adhesive material to the fibers until the fibers are substantially saturated and allowing the adhesive material to dry such that the fibers become essentially invisible; and (5) buffing the surfaces of the natural and artificial nails until the surfaces are substantially smooth.

In one embodiment, the natural nail is a human fingernail and the artificial nail is an artifical fingernail. The cellulose fiber material is preferably comprised of rayon fibers. In another embodiment, the method includes the step of trimming the artificial nail to the desired length and shape following the step of attaching the artificial nail to the natural nail and roughing-up the surface of the natural and artificial nails after the surface of the artificial nail is made substantially flush with that of the natural nail.

In a preferred embodiment, the artificial nail is attached to the natural nail by placing the artificial nail in abutting relationship with the natural nail so that at least a portion of the artificial nail overlaps the tip portion of the natural nail. A predetermined portion of the adhesive material, which is preferably a relatively fast-drying glue, is deposited on the surface of the natural nail along the line of transition between the respective surfaces of the natural and artificial nails. The artificial nail is then held stationary in abutting relationship with the natural nail until the glue dries and sets. After the artificial nail is trimmed to the desired length and shape and both the natural and artificial nails are rubbed with an abrasive mateiral as described above, a layer of rayon fiber material is placed on top of the natural and artificial nails, extending substantially over the entire surfaces of the natural and artificial nails and substantially beyond the tip of the artificial nail, but not in contact with the cuticle of the natural nail. The rayon fiber material is then saturated with the fast-drying glue and the glue is permitted to dry and set. A portion of the rayon fiber material which extends beyond the tip of the nail is then clipped off so that the fiber material is substantially coterminous with the tip of the artificial nail. The fiber material is then filed into the surfaces of the natural and artificial nails until such surfaces are substantially smooth. A disco buffer is then used to further smooth the surfaces of the artificial and natural nails. Following this smoothing operation, nail polish is then applied as desired.

DETAILED DESCRIPTION OF THE PREFERRED METHOD

In the description which follows, like parts are marked throughout the specification and drawings, respectively. The drawings are not necessarily to scale and in some instances proportions have been exaggerated in order to more clearly depict certain features of the invention.

Figure 1:
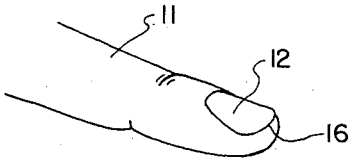
FIGS. 1–2 and 4–9 are various perspective views of a human finger and fingernail illustrating the consecutive steps of the method of the present invention.

Referring now to FIG. 1, a human finger 11 and fingernail 12 are illustrated. Prior to commencing the nail application process of the present invention, it is recommended that fingernails 12 first be manicured to provide a smooth, uniform contour at tip 16 of fingernail 12. Typically, during a manicuring process, the fingers are soaked in hand cream or hand lotion, which tends to leave an oily residue on the fingers and fingernails. This oily residue is difficult to remove and is likely to cause slippage of the artificial nail with the respect to the natural nail, resulting in a weak and unreliable attachment therebetween. In lieu of soaking the fingers in hand lotion or hand cream, the fingers should be soaked in a soapy water solution.

Figure 2:
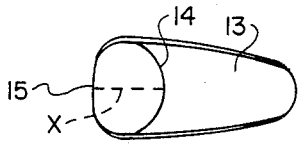

Referring now to FIG. 2, once the natural nail is manicured and properly prepared, the first step is to select an artificial nail 13 of the proper size and of the desired shape. Artificial nails 13 which are suitable for use in connection with the present invention are preferably of a cellulose material, such as, for example, cellulose acetate and tenite acetate, and should have a ridge member 14 which substantially conforms to the contour and shape of natural nail 12 for being positioned in abutting relationship with tip 16 of natural nail 12. There should be sufficient distance between base portion 15 of artificial nail 13 and ridge portion 14 to allow sufficient overlap between the respective contact surfaces thereof to provide a secure attachment therebetween. A distance on the order of one-fourth ($\frac{1}{4}$) to one-third ($\frac{1}{3}$) of an inch along axis X between base 15 and the apex of ridge portion 14 is sufficient. Suitable artificial nails 13 may be purchased from a variety of sources, including New Onyx Nail Products, of Westminster, Calif., and International Beauty Distributors, of Gardena, Calif.

Figure 3:
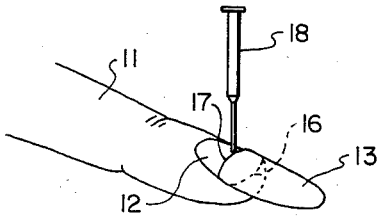
FIG. 3 is an elevational view of the undersurface of an artificial nail used in connection with the method of the present invention.
Figure 4:
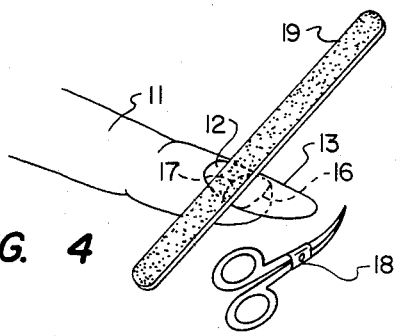
Figure 5:
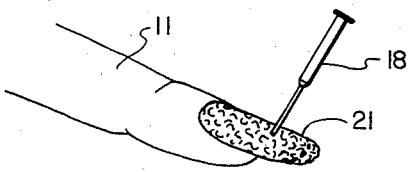

Referring now to FIG. 3, artificial nail 13 is positioned in abutting relationship with natural nail 12 so that tip 16 of natural nail 12 is in contact with ridge portion 14. A liquid adhesive material, which is preferably a fast drying glue comprised of the ingredient ethyl alpha cyanoacrylate, is applied to the surface of natural nail 12 along the line of transition 17 between natural nail 12 and artificial nail 13. The applicator mechanism for the adhesive material is illustrated as numeral 18 in FIG. 3. Adhesive material which is suitable for use in connection with the present invention is sold under the trademark "5 Second Nail Glue" by International Beauty Distributors, of Gardena, Calif. It is only necessary to deposit a small drop of the adhesive material on the surface of natural nail 12 because, upon application, the glue quickly flows underneath artificial nail 13 and dries to provide a secure bond between artificial nail 13 and natural nail 12 in the region indicated by the cross-hatched lines in FIG. 3.

After the glue has dried and set, artificial nail 13 is trimmed to the desired length and shape using scissors 18. Natural nail 12 and artificial nail 13 are then filed using a typical emery nail file 19, at the joinder 17 between natural nail 12 and artificial nail 13 on the exposed surfaces thereof, until the surface of artificial nail 13 is substantially flush with that of natural nail 12. A relatively thin layer of non-woven randomly intermingled cellulose fibers 21, which is preferably comprised of rayon fibers, is placed on top of natural nail 12 and artificial nail 13, extending over substantially the entire surfaces of natural nail 12 and artificial nail 13 and substantially beyond the tip of artificial nail 13, but not in contact with the cuticle of natural nail 12, so as not to damage the cuticle when fiber 21 is filed into the surface of natural nail 12 and artificial nail 13 as described below. Rayon fiber 21 is then saturated with the same fast-dyring glue which is used to attach natural nail 12 and artificial nail 13 and the glue is allowed to dry for a period of fifteen (15) to twenty (20) minutes such that the fibers become essentially invisible. During this fifteen (15) to twenty (20) minute waiting period, the nail specialist or manicurist can perform the manicuring process on the fingers of the other hand, to prepare those fingers for the application of artificial nails.

Figure 6:
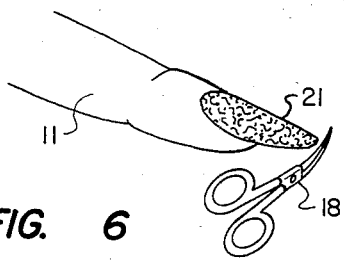
Figure 7:
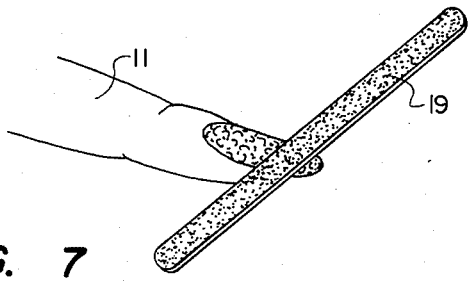
Figure 8:
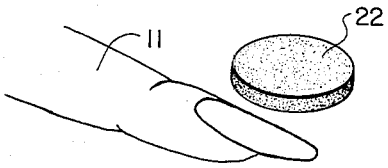
Figure 9:
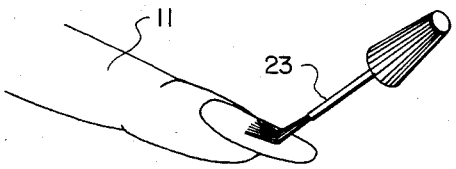

After the glue has sufficiently dried, the excess portion of rayon fiber 21, which extends beyond the tip of artificial nail 13 is then trimmed off with scissors 18, as illustrated in FIG. 6. The entire surfaces of both natural nail 12 and artificial nail 13 are then filed using emery file 19 until the surfaces are substantially smooth in appearance and to the touch. As illustrated in FIG. 8, natural nail 12 and artificial nail 13 are then buffed using a disco buffer 22 to further smooth the surfaces of natural nail 12 and artificial nail 3. After the surfaces are sufficiently smooth and buffed to present a natural and uniform appearance, nail polish may then be applied in the conventional manner using a nail polish applicator 23, as illustrated in FIG. 9.

The method of the present invention provides a strong, natural-looking nail which is sufficiently porous to allow the nail to "breathe", so as to inhibit the growth of fungus beneath the nail. Furthermore, the resulting nail is pliable and flexible and much more resistant to breaking, cracking and splitting than artificial nails applied using prior art methods. The resulting nail is also more durable than artificial nails applied using conventional paper, silk or other thin wraps, because the layer of rayon fiber 21 is sufficiently thick to hold the artificial nail in place despite numerous applications of nail polish remover. Nail polish remover tends to dissolve thin conventional paper wraps, thereby causing the artificial nail to become disengaged from the natural nail after only one or two applications of polish remover. The artificial nail applied using the method of the present invention may nevertheless be removed without damage to the natural nail by soaking the nail in polish remover for a period of ten to fifteen minutes. Typically, it takes on the order of only thirty seconds to remove nail polish without removing the artificial nail. Another important advantage of the method of the present invention is that the burning sensation and skin irritation which often accompany the application of artificial nails is substantially eliminated by using a fast-drying glue containing the ingredient ethyl alpha cyanoacrylate.

Although a preferred method has been described in detail, it should be understood that various substitutions, alterations and modifications may become apparent to those skilled in the art. For example, the method of the present invention may be used with equal success in the application of artificial toenails. These modifications can be made without departing from the spirit and scope of the invention as defined in the appended claims.

What is claimed is:

1. A method of applying an artificial nail to a natural nail, comprising the steps of:

(a) attaching the artificial nail to a natural nail using a liquid adhesive material;

(b) buffing the surfaces of the artificial nail and the natural nail until the surface of the artificial nail is substantially flush with that of the natural nail;

(c) placing a precut layer of non-woven, randomly intermingled cellulose fibers over substantially the entire surfaces of the natural and artificial nails without contacting the cuticle of the natural nail, said fibers being oriented substantially along the major axis of the respective surfaces of the natural and artificial nail;

(d) applying the adhesive material to the fibers until said fibers are substantially saturated and allowing the adhesive material to dry such that the fibers become essentially invisible; and, (e) buffing the surfaces of the natural and artificial nails until said surfaces are substantially smooth.

2. The method according to claim 1 wherein said natural nail is a human fingernail and said artificial nail is an artificial fingernail.

3. The method according to claim 1 wherein said cellulose fiber material is comprised of rayon fibers.

4. The method according to claim 1 further including the step of trimming the artificial nail to a desired length and shape following step (a) of the method.

5. The method according to claim 4 further including the steps of roughing-up the surface of the natural and artificial nails following step (b) of the method.

6. The method according to claim 1 wherein the step of attaching the artificial nail to the natural nail is comprised of the following sub-steps:

(i) placing the artificial nail in abutting relationship with the natural nail so that at least a portion of the artificial nail overlaps the natural nail;

(ii) applying liquid adhesive material to the surface of the natural nail at the point of transition between the surface of the natural nail and that of the artificial nail; and, (iii) maintaining the artificial nail stationary in abutting relationship with the natural nail until the adhesive material dries and sets.

7. The method according to claim 1 wherein the steps of placing a layer of cellulose fiber material over the natural and artificial nails and applying adhesive material to the fiber material are comprised of the following sub-steps:

(i) placing a layer of rayon fiber material on top of the natural and artificial nails so that the layer of rayon fiber extends over substantially the entire surfaces of the natural and artificial nails and substantially beyond the tip of the artificial nail, but is not in contact with the cuticle of the natural nail;

(ii) applying the liquid adhesive material to the rayon fiber material until said rayon fiber material is saturated and allowing the adhesive material to dry and set;

(iii) removing the portion of the rayon fiber material which extends beyond the tip of the artificial nail so that the rayon fiber material is substantially coterminous with the tip of the artificial nail.

8. The method according to claim 1 wherein the step of buffing the surfaces of the natural and artificial nails is comprised of the following sub-steps:

(i) filing the surfaces of the natural and artificial nails with a nail file until said surfaces are substantially smooth; and, (ii) buffing the surfaces of the natural and artificial nails with a disco buffer to further smooth the surfaces thereof.

9. The method according to claim 1 further including the step of applying nail polish to the surfaces of the natural and artificial nails after step (e) of the method.

* * * * *